US012304717B1

(12) United States Patent
Castaneda

(10) Patent No.: US 12,304,717 B1
(45) Date of Patent: May 20, 2025

(54) LIGHTWEIGHT AND SHOCK-PROOF PORTABLE CONTAINER ARRANGEMENT

(71) Applicant: Aldo Castaneda, San Francisco, CA (US)

(72) Inventor: Aldo Castaneda, San Francisco, CA (US)

( * ) Notice: Subject to any disclaimer, the term of this patent is extended or adjusted under 35 U.S.C. 154(b) by 44 days.

(21) Appl. No.: 18/199,850

(22) Filed: May 19, 2023

Related U.S. Application Data

(60) Provisional application No. 63/344,564, filed on May 21, 2022.

(51) Int. Cl.

| | |
|---|---|
| ***B65D 81/02*** | (2006.01) |
| ***B65D 8/00*** | (2006.01) |
| ***B65D 23/08*** | (2006.01) |
| ***B65D 43/16*** | (2006.01) |
| ***B65D 45/18*** | (2006.01) |
| ***B65D 81/30*** | (2006.01) |

(52) U.S. Cl.
CPC ..... *B65D 81/022* (2013.01); *B65D 15/02* (2013.01); *B65D 23/0828* (2013.01); *B65D 23/0857* (2013.01); *B65D 43/169* (2013.01); *B65D 45/18* (2013.01); *B65D 81/30* (2013.01)

(58) Field of Classification Search
CPC .... B65D 15/02; B65D 23/08; B65D 23/0828; B65D 23/0857; B65D 43/169; B65D 45/18; B65D 50/04; B65D 50/041; B65D 51/18; B65D 81/02; B65D 81/022; B65D 81/30; B65D 8/00; B65D 43/02; B65D 47/08
USPC ..... 206/521, 588, 591–594; 220/819, 220/833–849
See application file for complete search history.

(56) References Cited

U.S. PATENT DOCUMENTS

| | | | | |
|---|---|---|---|---|
| 3,265,520 | A * | 8/1966 | Obenshain | C03C 17/10 215/383 |
| 3,847,295 | A * | 11/1974 | Taylor | B65D 23/003 215/276 |
| 4,666,068 | A * | 5/1987 | Bush | B65D 47/0885 220/840 |
| 6,053,317 | A * | 4/2000 | Morris | B65D 81/3886 206/588 |
| 8,251,221 | B1 * | 8/2012 | Castaneda | B65B 5/04 206/592 |
| 8,579,133 | B2 * | 11/2013 | Marcus | B65D 81/022 206/459.5 |
| 9,004,281 | B1 * | 4/2015 | Castaneda | B65B 5/04 206/446 |
| 9,266,643 | B2 * | 2/2016 | Marcus | A47G 23/02 |
| 9,681,732 | B2 * | 6/2017 | Winter | A45D 33/00 |
| 9,993,055 | B2 * | 6/2018 | Waltrip | A45C 11/20 |
| 10,160,578 | B2 * | 12/2018 | Harvey | B65D 25/34 |

(Continued)

*Primary Examiner* — Bryon P Gehman
(74) *Attorney, Agent, or Firm* — John Rizvi; John Rizvi, P.A.—The Patent Professor ®

(57) ABSTRACT

A container arrangement is described. The container arrangement comprises a container configured to store one or more contents therein. The container is formed of a glass material. The container arrangement further comprises a sleeve configured to surround the container. The sleeve is formed of a silicone material. The container arrangement further comprises a cap configured to switch between an open state and a closed state. In the closed state, the cap is configured to prevent access to the one or more contents within the container.

7 Claims, 6 Drawing Sheets

(56) References Cited

U.S. PATENT DOCUMENTS

| | | | | |
|---|---|---|---|---|
| 2014/0251867 | A1* | 9/2014 | Castaneda | B65D 81/022<br>206/588 |
| 2016/0264316 | A1* | 9/2016 | Quinn | B65D 43/169 |

* cited by examiner

LIGHTWEIGHT AND SHOCK-PROOF PORTABLE CONTAINER ARRANGEMENT

CROSS-REFERENCE TO RELATED APPLICATIONS

This application claims the benefit of U.S. Provisional Patent Application Ser. No. 63/344,564 filed on May 21, 2022, which is incorporated by reference in its entirety.

FIELD OF THE INVENTION

The present invention relates generally to containers for storing different types of contents, and more particularly to a light-weight and shock-proof container for storing various types of contents.

BACKGROUND OF THE INVENTION

Glass is an ideal storage material for organic and other delicate substances. Glass, unlike various plastics and metals, is inert. Glass neither leeches nor absorbs chemicals leaving the contents of the glass container unharmed and un-altered.

However, though glass is the ideal storage material for organic and delicate substances, one of major drawbacks of glass based storage means is that such storage means are brittle and highly susceptible to shattering when dropped. Generally, glass containers are designed with thick, heavy glass so that glass containers do not shatter when dropped. However, the heavy glass containers are not always desirable.

Accordingly, there is an established need for a solution to the problems mentioned above. For instance, there is an established need for a light-weight glass container that is also shock-proof or shatter-proof. Further, there is an established need for a glass container that can safely and reliably store contents while at rest or during transportation. Furthermore, there is an established need for a glass container that ensures that contents stored therein are not degraded by ultraviolet (UV) or other light rays.

SUMMARY OF THE INVENTION

The present invention relates to a container arrangement. The container arrangement comprises a container configured to store one or more contents therein. The container is formed of a glass material. The container arrangement further comprises a sleeve configured to surround the container. The sleeve is formed of a silicone material. The container arrangement further comprises a cap configured to switch between an open state and a closed state. In the closed state, the cap is configured to prevent access to the one or more contents within the container.

In an aspect, the container arrangement further comprises a hinge mechanism coupled to the cap and the sleeve.

In an aspect, the cap is configured to rotate between the open state and the closed state about the hinge mechanism.

In an aspect, in the open state, the cap is configured to allow access to the one or more contents within the container.

In an aspect, the cap is integrally formed with the sleeve. In an aspect, the container arrangement further comprises a plug configured to engage with the cap. The plug is configured to lock the cap in the closed state thereof, when the plug is in engagement with the cap.

In an aspect, the cap comprises a first portion, a second portion, and a third portion, wherein the hinge mechanism is integrated with the first portion of the cap, and wherein the plug is configured to engage with the third portion of the cap.

In an aspect, the third portion of the cap comprises a through-hole, and wherein the plug is inserted into the through-hole to engage with the cap.

In an aspect, the glass material forming the container is a tinted glass.

In an aspect, the glass material forming the container is a borosilicate glass.

In an aspect, the sleeve is formed of a silicone material.

These and other objects, features, and advantages of the present invention will become more readily apparent from the attached drawings and the detailed description of the embodiments and examples, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
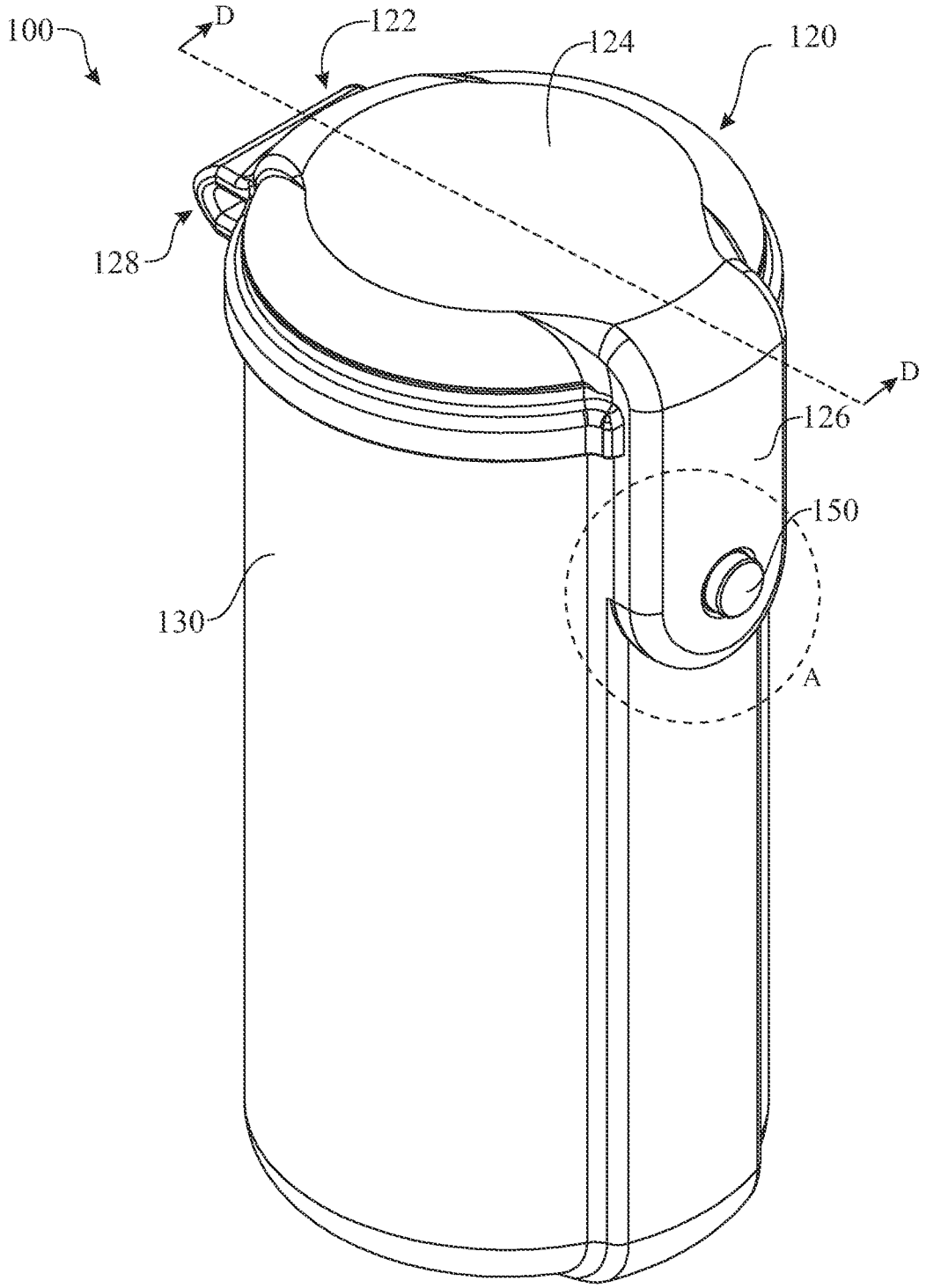
FIG. 1 illustrates a perspective view of a container arrangement, in accordance with one embodiment of the present specification.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other embodiments. All of the embodiments described below are exemplary embodiments provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the following description, certain specific details are set forth in order to provide a thorough understanding of various disclosed embodiments. However, one skilled in the relevant art will recognize that embodiments may be practiced without one or more of these specific details, or with other methods, components, materials, and the like. In other instances, well-known elements associated with containers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

As used in this specification and the appended claims, the singular forms "a," "an," and "the" include plural referents unless the content clearly dictates otherwise, and the vice versa. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

Reference is initially made to FIG. 1 which illustrates a perspective view of a container arrangement 100. The container arrangement 100 is configured for storing various types of contents. In some embodiments, the contents may comprise liquid substances, such as water, soda, beverages, and the like. In some embodiments, the contents may comprise personal items, such as pills. In some embodiments, the contents may comprise organic and delicate substances.

The container arrangement 100 may be configured to be portable such that a user may carry the container arrangement 100. The container arrangement 100 may thus act as a travel container where the user may take one or more items stored in the container arrangement 100.

The container arrangement 100 may comprise a container 110 (not visible in FIG. 1, visible in FIGS. 3-6), a cap 120, and a sleeve 130. In some embodiments, the cap 120 may be configured to be displaceable to allow access to the container 110. The sleeve 130 may be configured to completely surround the container 110, as will be described in detailed further below in the disclosure.

In some embodiments, the cap 120 may comprise a first portion 122, a second portion 124, and a third portion 126. The cap 120 may be displaceable about a hinge mechanism 128 such that rotation of the cap 120 about the hinge mechanism 128 in one direction may allow access to the container 110 and rotation of the cap 120 about the hinge mechanism 128 in another direction may block access to the container 110. In some embodiments, the hinge mechanism 128 may be provided at the first portion 122 of the cap 120. In some embodiments, the hinge mechanism 128 may be integrated with the first portion 122, in particular, an end of the first portion 122.

It is appreciated that although the illustrated embodiment depicts the hinge mechanism 128, the container arrangement 100 may comprise any other suitable mechanism that allows displacement of the cap 120.

In some embodiments, the hinge mechanism 128 may be coupled to the first portion 122 of the cap 120 such that the cap 120 may rotate about the hinge mechanism 128. In some embodiments, the hinge mechanism 128 may further be coupled to the sleeve 130 such that the hinge mechanism 128 acts as a connecting point between the cap 120 and the sleeve 130. That is, the hinge mechanism 128 may be coupled to both the first portion 122 of the cap 120 and the sleeve 130. For instance, a first part of the hinge mechanism 128 may be connected to the first portion 122 of the cap 120 and a second part of the hinge mechanism 128 may be connected to the sleeve 130.

In some embodiments, the cap 120 may be configured to shift between a closed state and an open state. In the closed state, the cap 120, in particular the second portion 124 of the cap 120, blocks access to the container 110 and in the open state, the cap 120 allows access to the container 110. In some embodiments, the cap 120 may be configured to displace about the hinge mechanism 128 in a rotatable manner so as to shift between the closed state and the open state.

Figure 2:
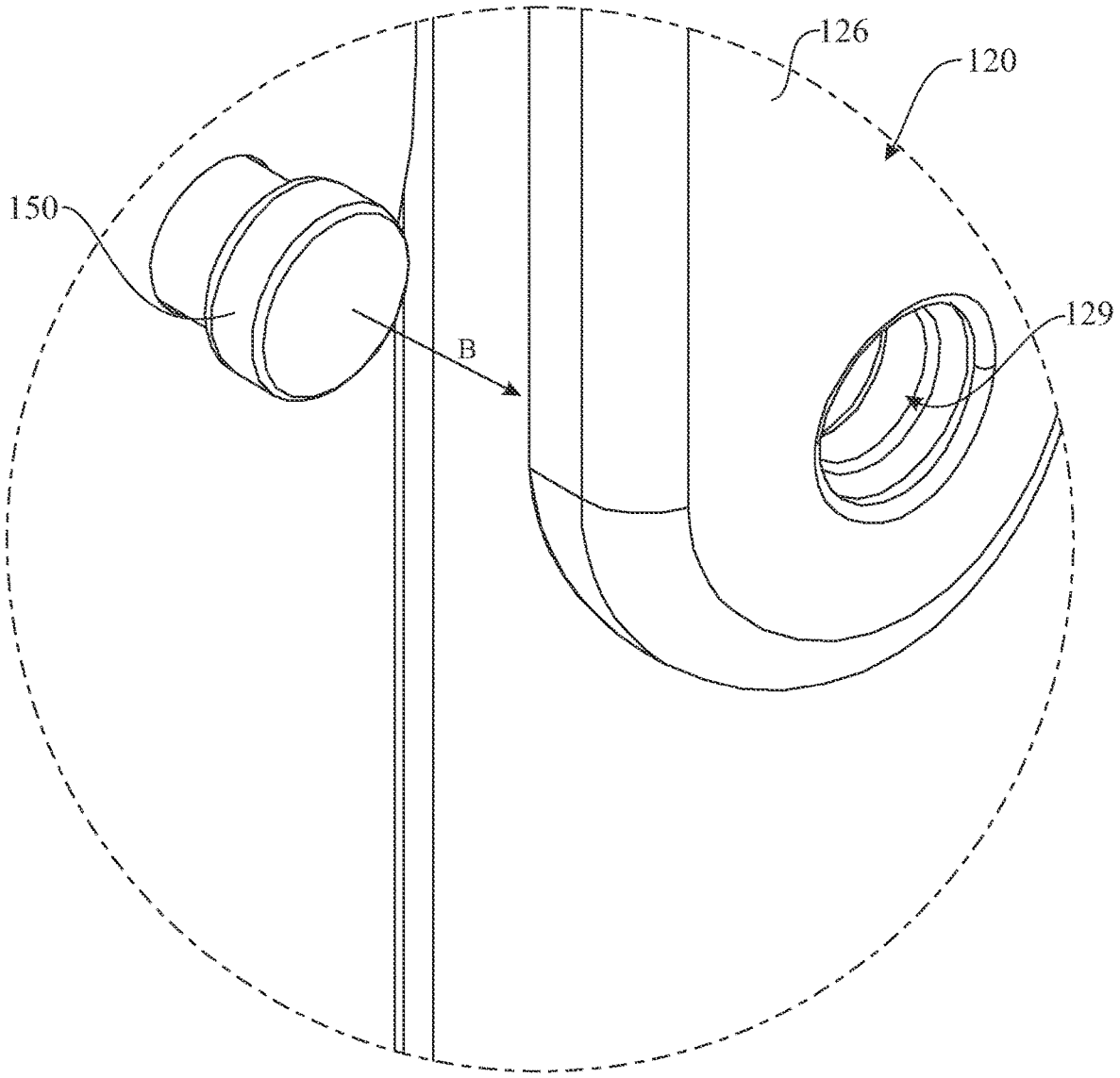
FIG. 2 illustrates a close-up view of block A in FIG. 1, in accordance with one embodiment of the present specification.

The container arrangement 100 may further comprise a plug 150 configured to engage with the cap 120, and the sleeve 130. The plug 150 may be configured to lock the cap 120 in the closed state thereof. Reference is made to FIG. 2 which illustrates a close-up view of block A in FIG. 1, in accordance with an embodiment of the present disclosure. The plug 150 may be configured to engage with the cap 120. In particular, the plug 150 may be configured to engage with the third portion 126 of the cap 120. As seen in FIG. 2, the third portion 126 of the cap 120 comprises a through-hole 129 configured for engagement with the plug 150. As shown by arrow B, the plug 150 may be inserted through the through-hole 129, such as, during assembly of the container arrangement 100. In some embodiments, the dimensions of the through-hole 129 may correspond to the dimensions of the plug 150 such that a secure engagement is achieved between the plug 150 and the cap 120, however, the plug 150 may disengage with the third portion 126 of the cap 120.

In some embodiments, the plug 150 may further be configured to engage with the sleeve 130 such that the plug 150 remains fixedly connected to the sleeve 130. In some embodiments, the plug 150 may be fixedly connected to the sleeve 130 by means of any suitable fixation means. In some embodiments, the plug 150 may be configured to facilitate switching of the cap 120 between the open state and the closed state. In some embodiments, the plug 150 may be configured to be pressed when a force is applied thereon, such as by a user pressing the plug 150. When pressed, the plug 150 may be configured to be displaced within the through-hole 129 so as to release the engagement with the third portion 126 of the cap 120, and further, the cap 120 may be displaced to the open state. When not pressed, the plug 150 may remain in engagement with the third portion 126 of the cap 120 and the cap 120 may remain in the closed state. Accordingly, pressing of the plug 150 may facilitate switching of the cap 120 between the open state and the closed state thereof.

Figure 3:
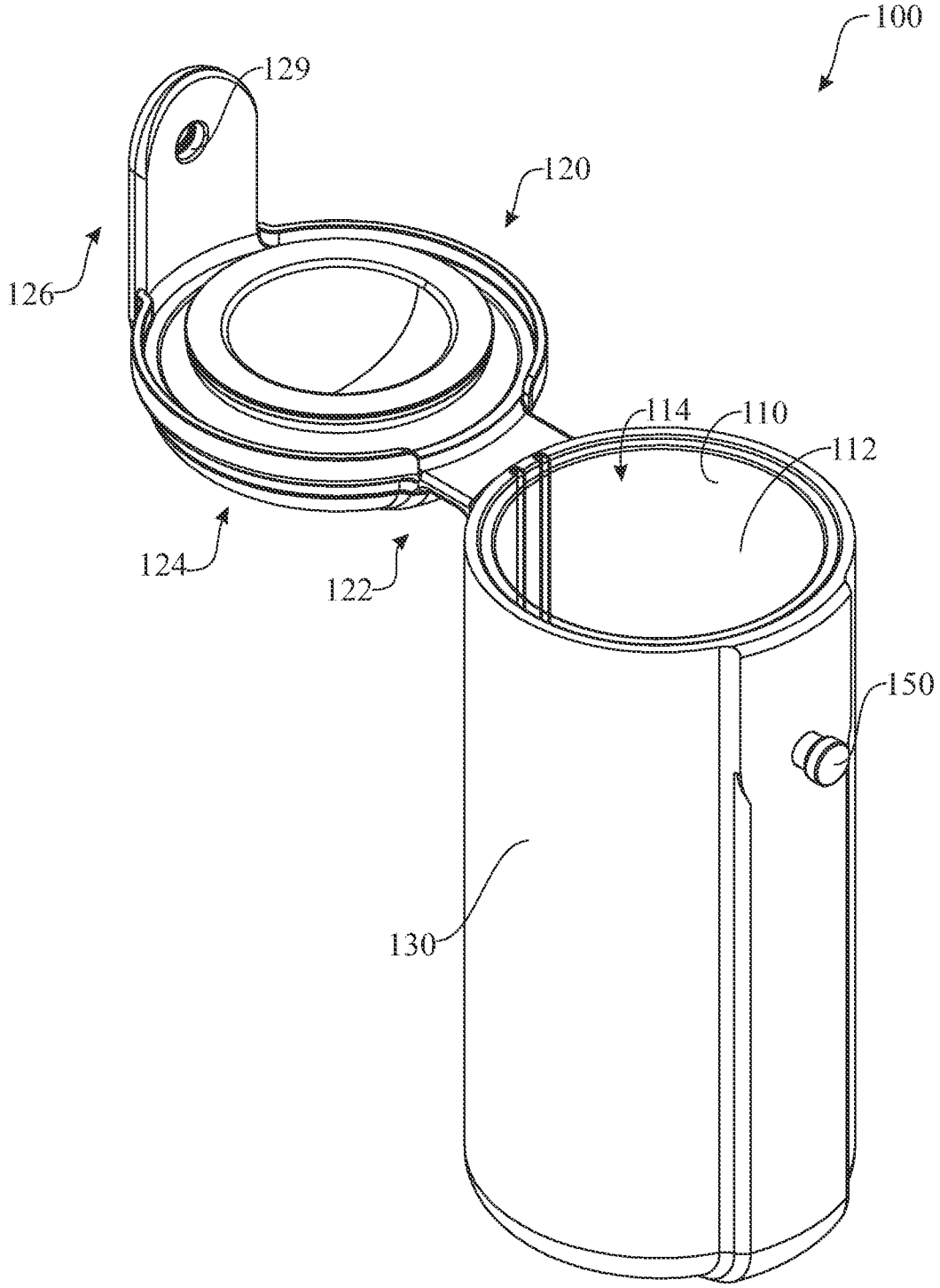
FIG. 3 illustrates a perspective view of the container arrangement, with the cap being in the open state, in accordance with one embodiment of the present specification.

Reference is made to FIG. 3 which illustrates a perspective view of the container arrangement 100, with the cap 120 being in the open state. As seen in FIG. 3, the third portion 126 of the cap 120 is released from engagement with the plug 150, and the cap 120 is free to be displaced, in a rotatable manner, about the hinge mechanism 128. Displacement of the cap 120 causes the second portion of the cap 120 to no longer block access to the container 110.

The container 110 may be disposed such that the sleeve 130 covers the container 110 in the entirety, in that, all portions of the container 110 may be covered by the sleeve 130. The container 110 may thus be configured to be disposed within the sleeve 130. In some embodiment, the dimensions of the container 110 may correspond to the dimensions of the sleeve 130 such that the container 110 snugly fits within the sleeve 130.

The container 110 may comprise a body 112 and an opening 114. The body 112 may define an interior space that is configured to store one or more contents there-within. The opening 114 may be configured to allow access to the interior space, and consequently, to the one or more contents stored in the interior space. That is, the opening 114 allows access to inside of the container 110, for instance, to store one or more contents by inserting said contents into the interior space of the container 110 and to take out the stored contents as and when desired.

When the cap 120 is in the closed state, the second portion 124 of the cap 120 may cover the opening 114 of the container 110, thereby blocking access to the one or more contents stored within the container 110. When the cap 120 is in the open state, as seen in FIG. 3, the second portion 124 of the cap 120 may no longer cover the opening 114 of the container 110, thereby allowing access to the one or more contents stored within the container 110.

Figure 4:
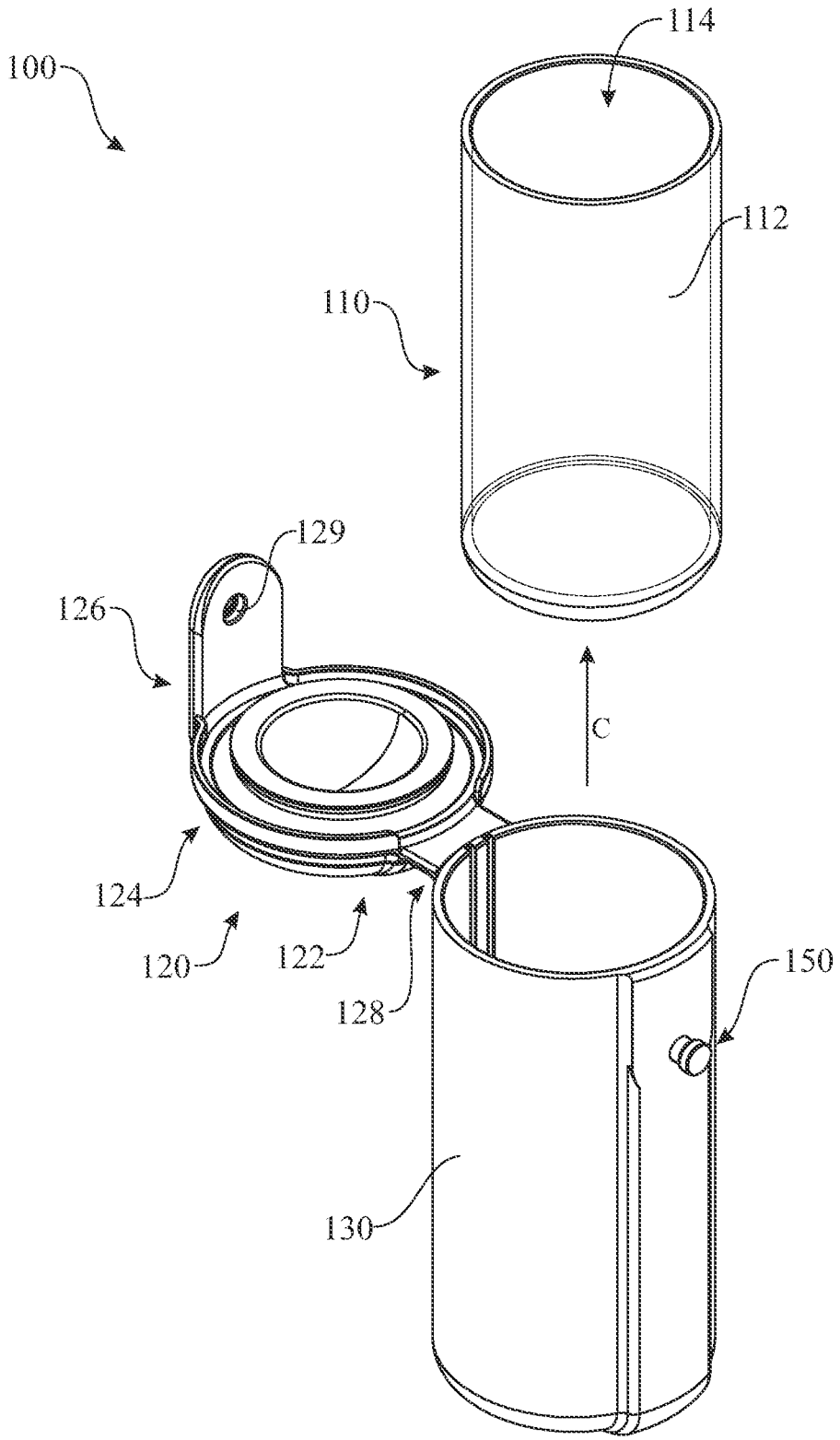
FIGS. 4-5 illustrate perspective views of the container arrangement with the cap in the open state and the container being out of the sleeve, in accordance with one embodiment of the present specification.
Figure 5:
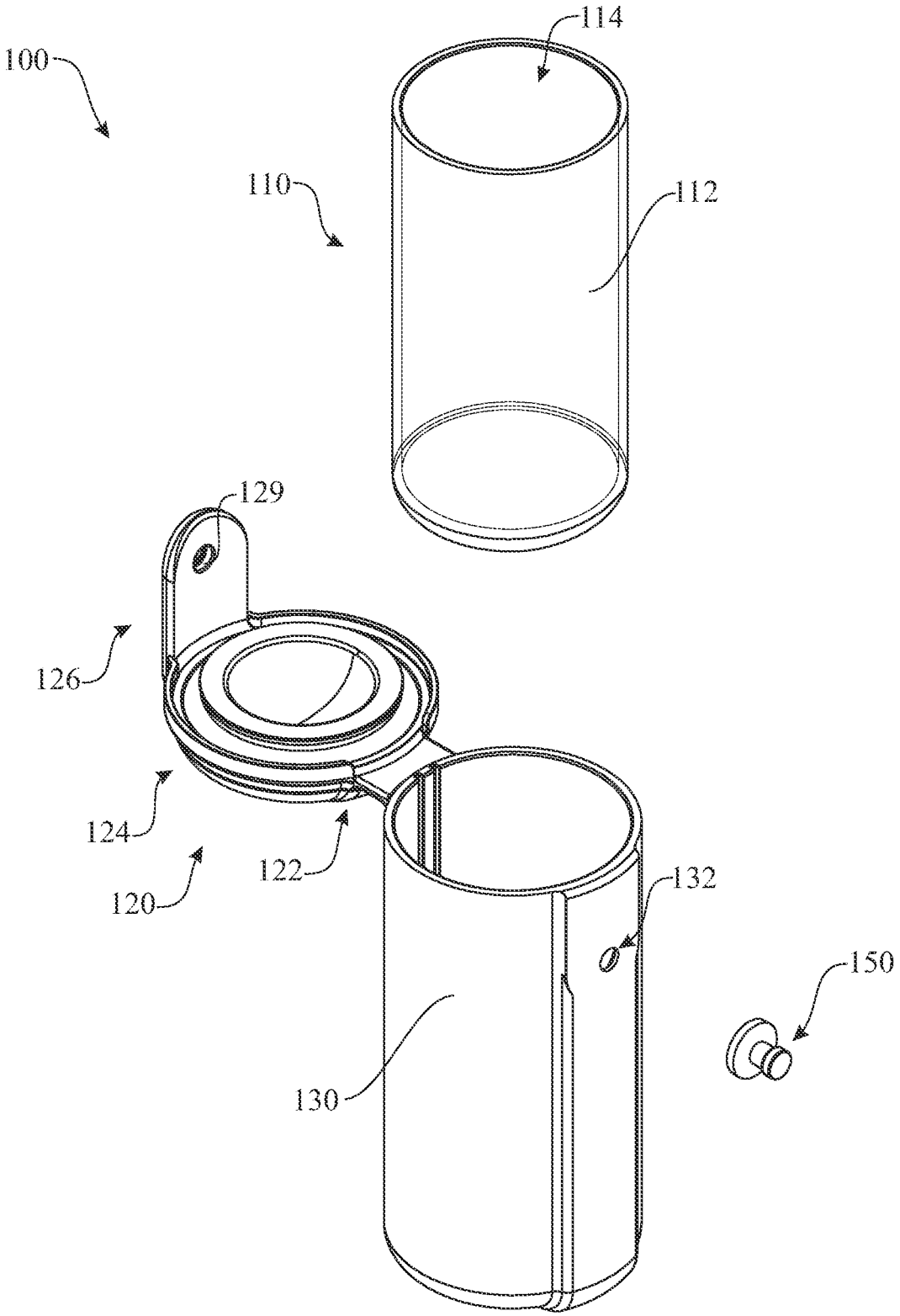

Reference is made to FIGS. 4-5, which illustrate perspective views of the container arrangement 100 with the cap 120 in the open state and the container 110 being out of the sleeve 130. As seen in FIG. 4, the sleeve 130 may be integrated with the cap 120 so as to form a single element. In some embodiments, the sleeve 130 and the cap 120 may be fixedly coupled, such as, during manufacturing of the sleeve 130 and/or the cap 120, thereby preventing cap loss. In some embodiments, the sleeve 130 may additionally extend, at least partially, over the cap 120. This may prevent the cap 120 from accidentally opening while in use or during traveling.

As seen in FIG. 4, the sleeve 130, coupled with the cap 120, may be configured to be shifted over the container 110 so as to cover the container 110. For instance, as depicted by arrow C, the sleeve 130 and the cap 120 may be shifted over the container 110. Once the container 110 is disposed within the sleeve 130, the cap 120 may be rotated about the hinge mechanism 128 so as to cover the opening 114 of the container 110. The plug 150 may engage with the cap 120 so as to lock the cap in the closed state in which the cap 120 covers the opening 114 of the container 110.

As seen in FIG. 5, in some embodiments, the sleeve 130 may be provided with suitable patterns and designs in order to increase the aesthetic appearance of the container arrangement 100. For instance, the sleeve 130 may be provided with a logo. In some embodiments, the sleeve 130 may be provided with a grooved pattern. In some embodiments, the sleeve 130 may further be provided with instructions for use. It is appreciated that the logo may be provided at any other suitable position, such as, on the cap 120 or any other location on the sleeve 130.

Further, the plug 150 may be configured to be fixedly coupled to the sleeve 130 in a position to correspond to the through-hole 129 of the cap 120 when the cap 120 is in the closed state. As seen in FIG. 5, in which the plug 150 is depicted as separated from the sleeve for illustration purposes, the sleeve 130 may comprise an aperture 132 configured to allow a portion of the plug 150 to pass therethrough, thereby coupling the plug 150 to the sleeve 130, as seen in FIG. 4. In some embodiments, the plug 150 may be formed of a plastic material, such as in a non-limiting example, polyethylene.

Figure 6:
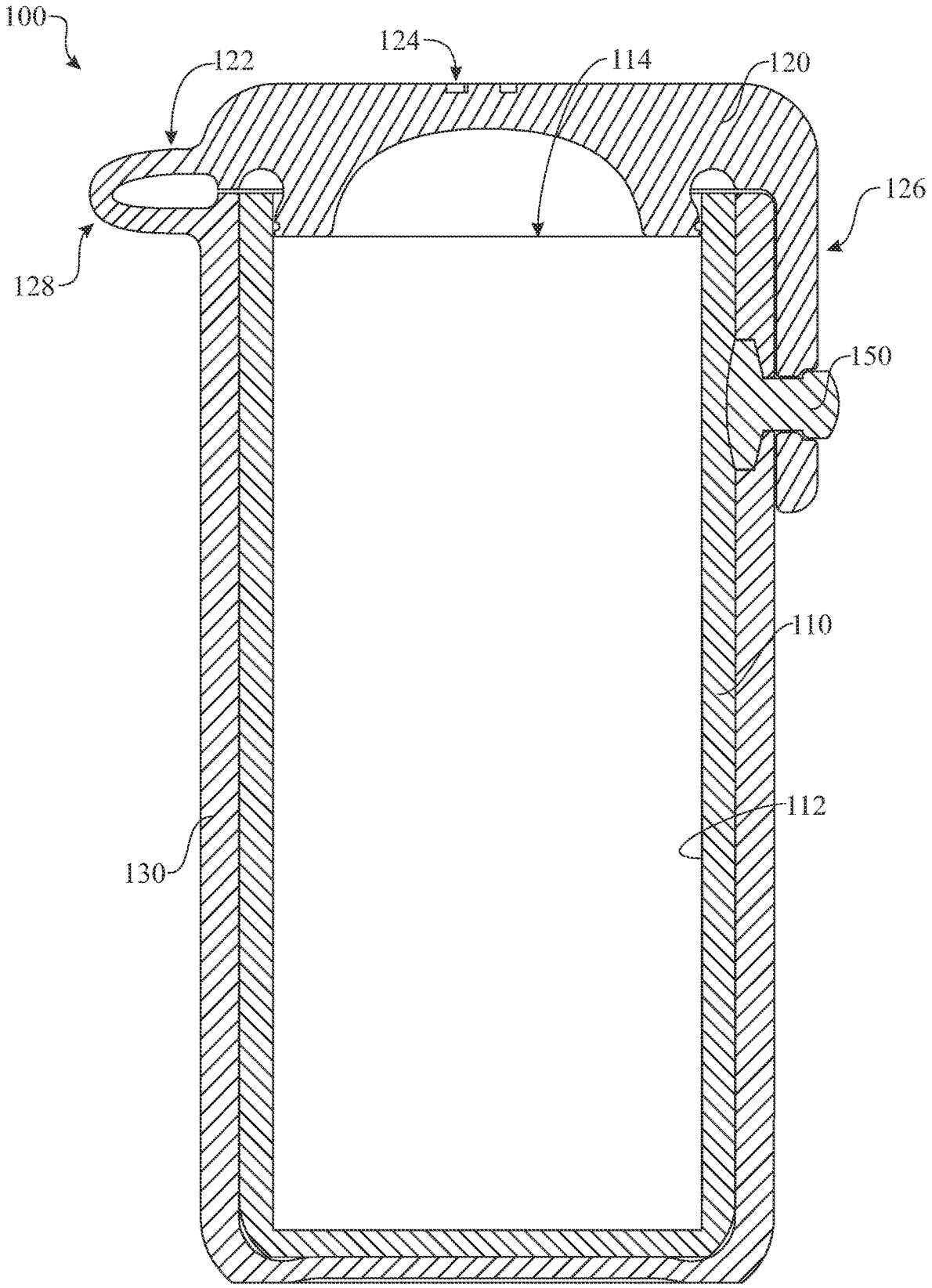
FIG. 6 illustrates a cross-sectional view of the container arrangement of FIG. 1, the cross-section being taken along line D-D, in accordance with one embodiment of the present specification.

Reference is made to FIG. 6 which depicts a cross-sectional view of the container arrangement 100, the cross-section being taken along the line D-D in FIG. 1. As seen in FIG. 6, the container 110 is entirely covered by the sleeve 130. The cap 120 is in the closed state and covers the opening 114 of the container 110. The plug 150 is fixedly attached to the sleeve 130, and is in engagement with the cap 120, in particular, the third portion 126 of the cap 120 so as to hold the cap 120 in the closed state and prevent displacement of the cap 120, about the hinge mechanism 128, into the open state.

In the illustrated embodiment, the container 110 has a cylindrical shape in that the body 112 of the container 110 is a cylindrical body. It is appreciated that the body 112 can be in any other suitable shape and size for use as a container to store one or more contents. In non-limiting examples, the body 112 may be of a spherical shape, a cubical shape, a cuboidal shape, and the like.

The one or more contents that may be stored in the container 110 may include any content that the user desires to carry along with the container arrangement 100. Some non-limiting examples of the one or more contents include consumable liquids like water and beverages, consumable food, personal items like cards, keys and key chains, currency notes and/or coins, earphones and/or air pods, and various organic items.

In some embodiments, the container 110 may be formed of glass, for example, borosilicate glass. As the container 110 is formed of glass, organic and delicate contents can easily be stored within the container 110. This is because glass is inert and would not react with the stored contents. Moreover, there are no issues related to leeching and absorption of chemicals. The contents within the container 110 thus remain unaltered and unharmed.

In some embodiments, the glass for forming the container 110 may be clear glass. In some embodiments, the glass for forming the container 110 may be a tinted glass. In some embodiments, the glass for forming the container 110 may be coated with a paint so as to increase opacity of the container 110. This prevents harmful light rays from entering through the container 110. The contents stored within the container 110 are thus not degraded by ultraviolet (UV) rays and other harmful light rays.

In some embodiments, the sleeve 130 may be formed of a silicone material. In some embodiments, the sleeve 130, when covering the container 110, may protect the container 110 from shocks and drops. Moreover, the sleeve 130 enhances the light blocking capabilities of the container arrangement 100.

In some embodiments, the cap 120 may be configured to cover the opening 114 of the container 110 in a tight, repeatable manner so as to form an air-tight seal. Accordingly, the contents may be stored safely and in a reliable manner within the container, during rest as well as during travels. In some embodiments, the cap 120 may be formed of a rigid material. In some embodiments, the cap may be formed in a variety of shapes and sizes, and may further comprise protrusions and/or indentations to enable simplifies one-hand operation of the cap 120.

In some embodiments, the container 110 is completely covered by the sleeve 130 and the cap 120, such that, the sleeve 130 covers the body 112 of the container 110 and the cap 120 covers the opening 114 of the container 110. The sleeve 130 and the cap 120 protects the container 110 from falls and shocks. The container 110 may thus be made of a thin glass structure as the container 110 would be shatter-proof and shock-proof by virtue of the sleeve 130 and the cap 120. The container arrangement 100 is thus lightweight and easily portable. A lightweight, portable, shockproof, light-blocking container arrangement 100 is thus obtained Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A container arrangement comprising:

a container configured to store one or more contents therein, the container being formed of a glass material;

a sleeve configured to surround the container, the sleeve being formed of a silicone material; and a cap, integrally formed with the sleeve, configured to switch between an open state and a closed state, wherein in the closed state, the cap is configured to prevent access to the one or more contents within the container, the cap comprising a first portion, a second portion, and a third portion, the first portion of the cap comprising a hinge mechanism at an end of the first portion, the hinge mechanism being first coupled to the sleeve such that the hinge mechanism act as connection between the cap and the sleeve, the third portion of the cap comprising a through-hole; and a plug, fixedly connected to the sleeve, configured to lock the cap in the closed state thereof, when the plug is inserted into the through-hole of the third portion of the cap.

2. The container arrangement of claim 1, wherein the cap is configured to rotate between the open state and the closed state about the hinge mechanism, and wherein, in the open state, the cap is configured to allow access to the one or more contents within the container.

3. The container arrangement of claim 1, wherein the glass material forming the container is a tinted glass.

4. The container arrangement of claim 1, wherein the glass material forming the container is a borosilicate glass.

5. The container arrangement of claim 1, wherein the glass material forming the container is coated.

6. The container arrangement of claim 1, wherein the plug is configured to be displaced within the through-hole when being pressed, thereby displacing the cap from the closed state to the open state.

7. The container arrangement of claim 1, wherein upon being inserted into the through-hole, the plug is configured to remain in engagement with the third portion of the cap in absence of any force being applied thereon.

* * * * *